United States Patent [19]

Müller et al.

[11] Patent Number: 4,620,585

[45] Date of Patent: Nov. 4, 1986

[54] APPARATUS FOR THE COMPACTION OF FOUNDRY MOLD MATERIAL

[75] Inventors: Günter Müller, Karlsruhe; Norbert Damm, Karlsdorf-Neuthard; Günter Kuppinger, Karlsruhe, all of Fed. Rep. of Germany

[73] Assignee: BMD Badische Maschinenfabrik Durlach GmbH, Karlsruhe, Fed. Rep. of Germany

[21] Appl. No.: 617,920

[22] Filed: Jun. 6, 1984

[30] Foreign Application Priority Data

Jun. 15, 1983 [DE] Fed. Rep. of Germany ..... 3321622

[51] Int. Cl.[4] ..... B22C 15/00

[52] U.S. Cl. ..... 164/169

[58] Field of Search ..... 164/37, 38, 39, 40, 164/170, 169, 195

[56] References Cited

U.S. PATENT DOCUMENTS 3,659,642 5/1972 Vasilkovsky et al. ..... 164/37

FOREIGN PATENT DOCUMENTS 2069384 8/1981 United Kingdom ..... 164/169
425719 10/1974 U.S.S.R. ..... 164/169
521993 9/1976 U.S.S.R. ..... 164/169
818727 5/1981 U.S.S.R. ..... 164/169
793696 12/1981 U.S.S.R. ..... 164/169

*Primary Examiner*—Nicholas P. Godici
*Assistant Examiner*—G. M. Reid
*Attorney, Agent, or Firm*—Antonelli, Terry & Wands

[57] ABSTRACT

An apparatus for the compaction of foundry mold making material using gas under pressure, comprises a pressure vessel for the such gas, a mold flask, a filling frame, a pattern plate and a pattern thereon onto which the material is to be loosely heaped. The flask, frame and plate form a mold chamber under the pressure vessel and between them there a valve is placed, the valve having a movable valve member adapted to open up a flow cross section of the valve predominantly under the effect of gas under pressure in the pressure vessel. The valve member is guided within the pressure vessel, with the valve member being adapted to perform an opening motion, which at least mainly directed into the mold chamber.

11 Claims, 2 Drawing Figures

APPARATUS FOR THE COMPACTION OF FOUNDRY MOLD MATERIAL

BACKGROUND OF THE INVENTION

The present invention relates to an apparatus for the compaction of foundry mold making material using gas under pressure and made up of a pressure vessel forming an inlet space or initial pressure stage for the gas under pressure, a mold chamber placed thereunder and formed by a mold flask with a filling frame and a pattern plate with a pattern thereon shutting off the mold chamber and onto which the mold making material is loosely heaped prior to compaction, and a valve placed between the pressure vessel and the mold chamber, the moving member of the valve opening (i.e. freeing the opening cross section of the valve) predominantly under the effect of the pressure in the pressure vessel.

An apparatus of the aforementioned type is disclosed in, for example, U.S. application Ser. No. 453,093, now U.S. Pat. No. 4,524,310, wherein the process for compacting mold material, more particularly in the form of foundry sand, made use of gas under pressure, as, for example, air under pressure or of gas pressurized by explosive combustion, the violent impact effect of which is such that the gas expanded out of a pressure vessel into the mold chamber to take effect on the free surface of the mold material causing compaction thereof by mutual exchange of momentum and by the deceleration of the mass of foundry material after it had first been accelerated on the top side of the pattern and the pattern plate. Furthermore, there were fluidizing effects and a concomitant decrease of friction between the particles. In the above mentioned patent, it was important to get a high mass flow of the gas and the highest possible rate of increase in pressure in the mold chamber. The lower the starting pressure in the pressure vessel, the higher these parameters had to be. The starting pressures were within the pressure range of commercial plant compressed air supplies in order to reduce costs, for the provision of the compressed gas and for the pressure control systems. Thus, the apparatus had to be fitted with a valve member capable of shutting down the largest possible cross section used for the transfer of the gas under pressure, and had to have a very low mass to make it possible for the cross section to be opened or uncovered in the shortest possible time or as instantaneously as possible. Furthermore, it was necessary to have valve opening drives capable of moving the valve member in a few milliseconds into the opened position to clear the flow path through the valve. It is not possible to meet these conditions using a normal commercial valve.

The above noted U.S. patent proposed some possible forms of valve design to maintain the desired conditions. Thus, for example, the gas under pressure was used at least for initiating or triggering the opening stroke of the valve so as to provide the most rapid possible equalization of pressure on the two sides of the valve member and so that any further opening motion of the member did not have to take place against the pressure effect. In all these designs the valve member was placed that it was moved directly into the pressure vessel, something which, in turn, made a special design of the valve member necessary.

Based on the above noted patent, utilizing the pressure gradient between the pressure valve and the mold chamber for opening the valve, an object of the present instant invention resides in providing an apparatus wherein the opening of the flow cross section is effected solely by the action of the gas under pressure.

In accordance with the present invention, the valve member is guided within the pressure vessel and an opening motion thereof is mainly directed into the mold chamber.

In the apparatus described in the above noted patent, the valve member is located wholly within the pressure vessel and opened therein however, in the present invention, the valve member is opened in the direction of the flow of the gas under pressure transferring into the mold chamber, thereby providing for a more effective way of working, and simpler means for maintaining the valve member in a closed position.

In accordance with the present invention, the valve member includes a valve plate having a plurality of openings formed, for example, by slots, with the plate cooperating with a stationary plate placed over it and between the pressure vessel and the mold chamber. The stationary plate includes openings such that the openings in the valve plate and in the stationary plate are out of line with each other so as to provide a gas-tight sealing effect. Furthermore, the valve plate is locked in the closed position by a locking means such that when it is unlocked it is accelerated by the gas under pressure into the mold chamber.

The valve plate and the stationary plate are formed as a sort of grating so designed that in the closed position the openings in the two plates do not overlap each other. That is to say, the openings in the stationary plate are closed by the valve plate and the holes in the latter are closed by the stationary plate. As soon as the least downward motion of the valve plate has taken place, the gas under pressure flows through the openings in the stationary plate and in the valve or moving plate into the mold chamber. Thus, for the expansion of the gas under pressure into the mold chamber, the valve member only has to be shifted through a very small distance to uncover or free the largest possible flow cross section.

Because, as a rule, flasks and filling frames are generally rectangular, it is best for the valve to have a rectangular form corresponding to the rectangular cross section of the mold chamber in order in this respect as well to get the maximum open or flow cross section and an equal distribution of the gas under pressure over the surface of the mold material.

In order to be certain of producing a hermetic seal in the closed position of the valve, the valve plate or the stationary plate are surfaced with a sealing layer on adjacent faces thereof, with the sealing layer extending around all the holes in the plate. More specially, the sealing layer is fixed to the valve plate rather than on a counterpart thereof.

In accordance with further features of the present invention the valve member is constructed as a thin valve diaphragm of a flexible material, that closes the opening between the pressure vessel and the mold space or chamber, with the valve member being sealingly locked in position at its edge when the valve is shut and, when unlocked and acted upon by the gas under pressure, sweeps inwards and downwards into the mold chamber.

The valve diaphragm may, for example, be made of rubber, a resin having the elastic properties of rubber, or of a resin with other elastic properties, with the only important factor being that the cross section of the material and the properties thereof are such that, when the edge of the valve diaphragm has been unlocked and it is acted upon by the gas under pressure, it swept or flapped as rapidly as possible into the mold chamber under the action of the gas under pressure and so uncover the maximum possible cross section of the opening. In this case as well the opening motion is caused solely by the action of the gas under pressure after the edge of the valve diaphragm has been unlocked.

By virtue of the above-noted features of the present invention it is possible for the opening between the pressure vessel and the mold to match the free cross section of the mold chamber, the valve diaphragm taking up, in the closed condition of the valve, a position within the pressure vessel such that its edge is placed on the floor part thereof around the opening. Because of the large opening cross section then made possible and the sudden opening of the cross section by the folding back of the valve diaphragm, the desired mass flow of gas and the sudden increase in pressure within the mold chamber may be produced very simply.

The flexible valve diaphragm may be maintained in the closed position by a loading ring or frame, that acts on its outer edge and is controlled by a locking and unlocking system. This ring or frame, that is also acted upon by the effect of the gas under pressure, forces the valve diaphragm against the pressure vessel floor round the opening. The loading ring or frame may be made with a relatively small mass so that only a small driving force is needed to lift it clear and start the opening motion of the valve diaphragm.

As a further part of a preferred form of the invention the material that the valve diaphragm produces a restoring force tending to move the valve diaphragm back into a position generally answering to the closed position. The valve diaphragm, that by virtue of the elastic nature is thereof forced into the mold chamber when the valve is opened, and will return to a straightened position by itself when the pressure is equalized and will go into a position, in which it is again within the pressure vessel and may be forced into contact at its edge by a closing drive that acts on the loading ring or frame.

In the case of this form of the invention there is the further feature that the valve member is mounted on a middle guide rod, by way of which it may be moved out of the valve-open position into the shut position, and by way of which a clamping device, responsible for the locking effect, may be locked in the closed position of the valve member.

This being so, the valve plate may be moved by the guide rod out of the open into the closed position. Then the guide rod is locked by the clamping device so that the pressure vessel may be filled with the gas under pressure. By releasing the clamping device, the valve plate will be freed and the pressurized gas acting on it will violently accelerate it into the open position. The clamping device forming part of the present invention with its radial action on the guide rod gives the useful effect that to release it only a very small displacement is required and consequently such displacement will be completed in a very short period of time and will be more or less instantaneous.

The closing drive for working the valve member may be in the form of a fluid pressure actuator acting on the guide rod and which after the guide rod has been gripped by the clamping device is unjoined from the guide rod, at least at the commencement of the opening motion. Subsequently, the driving connection is restored and the valve plate is moved back into the closed position by the guide rod.

If the valve plate is fabricated from a flexible material as a diaphragm, the ring or frame, designed to press on the edge of the valve diaphragm plate, will be mounted on the lower part of a two-part guide rod, whose lower part is guided so that it may slide to a limited degree in relation to the top part in the axial direction. The ring or the frame has springs for storing energy and which are rested against the edge of the opening and are tensioned when the valve is being closed, whereas, after the clamping device has been released, such springs accelerate the ring or frame upwards with the lower part of the guide rod, the valve diaphragm edge then being released. Under the effect of the gas under pressure the valve diaphragm is drawn out of the gap between the ring or frame and the floor round the opening of the pressure vessel and folds or flaps into the mold chamber.

Further details and useful effects of the invention will be gathered from the account now to be given of two working examples thereof using the figures herein.

FIG. 1 is a longitudinal section of one working example of the invention with a rigid valve plate; and FIG. 2 is a longitudinal cross section on generally the same lines as FIG. 1 through a form of the invention using a flexible valve diaphragm.

DETAILED DESCRIPTION

Figure 1:
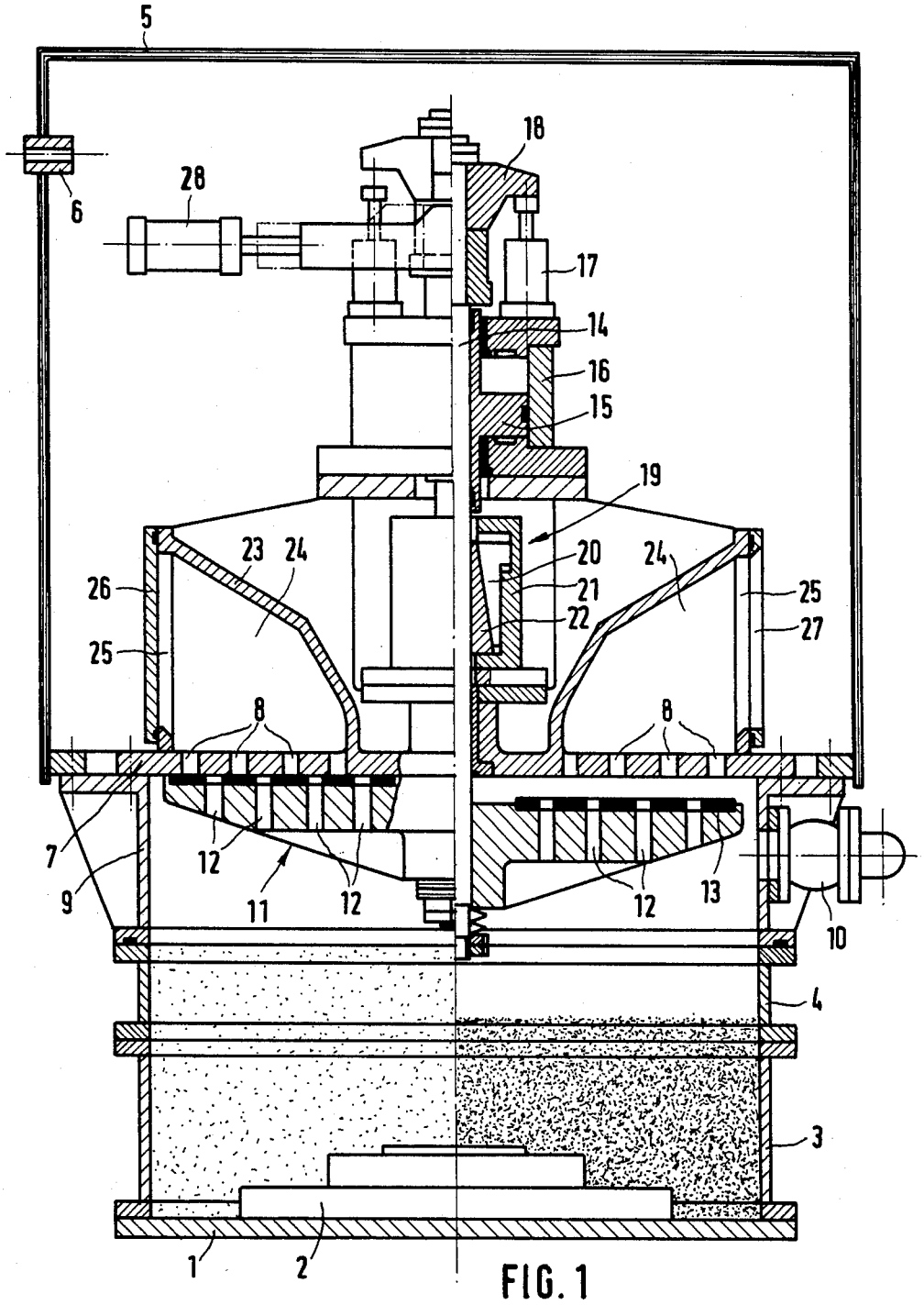

Referring now to the drawings wherein like reference numerals are used throughout the various views to designate like parts and, more particularly, to FIG. 1, according to this figure, a flask 3 is seated on a pattern plate 1 with a pattern 2 and a filling frame 4 is placed on the flask 3. Over the mold chamber there is a pressure vessel 5, which in the present working example takes up compressed air when supplied therewith by way of a connection line 6 coming from a pressure receiver or, if the input pressure is lower, by way of the compressed air line in the plant.

As its floor or lower wall 7 the pressure vessel has a stationary plate, whose part over the mold chamber is perforated with, for example, slots 8 so that it resembles a grating. On the lower side of the floor 7, a frame 9 is fixed in position by way of a flange and it in turn is joined up with an air let off pipe having a valve 10. The pressure vessel 5 with the frame 9 on the one hand and the pattern plate 1 with its pattern 2, the flask 3 and the filling frame 4 on the other hand are able to be parted to make it possible for the mold chamber to be charged with mold material. Prior to compaction these two units are moved and pressed together at their parting faces.

A valve member, in the form of a stiff plate 11, is provided for cooperation with the part of the floor 7 having the slots 8. The plate 11 also includes slots 12. Furthermore a sealing layer 13 is seated on the top side of the valve plate on the part thereof with the slots 12 and within the area of the slots in the floor 7. As will be clear from the left hand side of FIG. 1, the slots 8 in the floor 7 and the slots 12 in the valve plate 11 are positioned so that they are not aligned with each other when the valve is closed.

The valve plate 11 is mounted on a guide rod generally designated by the reference numeral 14, that is able to be lifted by a driving piston 15 sliding on it out of the position to be seen on the right (the open position of the valve plate) into the closed position as shown in the left of FIG. 1. Shock absorbing cylinders 17 are mounted on the stationary cylinder 16, placed within the pressure vessel 5, belonging to the driving piston 15. The shock absorbing cylinders 17 cooperate with a cross head 18 fixed on the guide rod 14. The top end of the driving piston 15 acts against the cross head 18 when the piston is moved upwards. Furthermore the guide rod 14 includes a clamping device generally designated by the reference numeral 19 and one gripping part 20 axially movable within a housing 21 supported on the floor and another clamping part 22 seated on the guide rod. The clamping parts may be wedges or the like.

Finally, a support part 23 is provided on the floor, with the support part 23 partitioning a flow transfer space 24 with the floor 7. The support part has coaxial slots 25 in its outer wall that are covered over by an outer turning ring 26, which includes slots 27.

In the closed position of FIG. 1, wherein the slots 25 in the support part 23 are shut off or closed by the ring 26, the pressure vessel 5 may be filled with gas under pressure by the connection line 6. The clamping device 19 maintains the valve plate 11 forced gas-tightly against the floor 7, and the mold flask 3 and the filling frame 4 have been filled with loose foundry sand.

To start the opening stroke, the ring 26 is turned so that the slots 27 thereof are aligned with the slots 25 in the support part 23 as illustrated in the right hand part of FIG. 1 and so that the gas under pressure moves into the transfer space 24. Subsequently a mechanical safety catch 28 is released and the driving piston 15 is lowered with the clamping device 19 in the locking condition, it sliding down the guide rod 14. After this, the clamping device 19 is hydraulically taken off so that the guide rod 14 and the valve plate 11 are free to move. The gas, under pressure, moving through the slots 8 and acting on the valve plate 11 violently accelerates the plate in a downward direction so that the gas under pressure is able to expand through the slots and through the gap between the edge of the plate 11 and the inner wall face of the mold chamber. While this opening stroke is taking place the guide rod 14 is decelerated because the cross head 18 runs down onto the shock absorbing cylinders 17. The valve plate moves as far as the position marked on the right hand side of FIG. 1. At the same time the foundry sand is accelerated and then decelerated on the pattern plate 1 and the pattern 2 itself and is compacted. At the end of the opening stroke the ring 26 is twisted back again to stop escape of gas from the vessel 5 when a further filling operation is to take place. It is furthermore possible for the gas mass flow to be set by adjustment of the ring 26, for the purpose of changing the hardness of the mold to meet particular needs. The driving piston 15 is then moved so that by way of the cross head 18 the guide rod 14 with the valve plate 11 is lifted back up again and locked in the shut position (see the left hand side of the figure) by the clamping device. The safety catch 28 is put on again, and at the same time the gas under pressure still present in the mold chamber is released through the valve 10.

Figure 2:
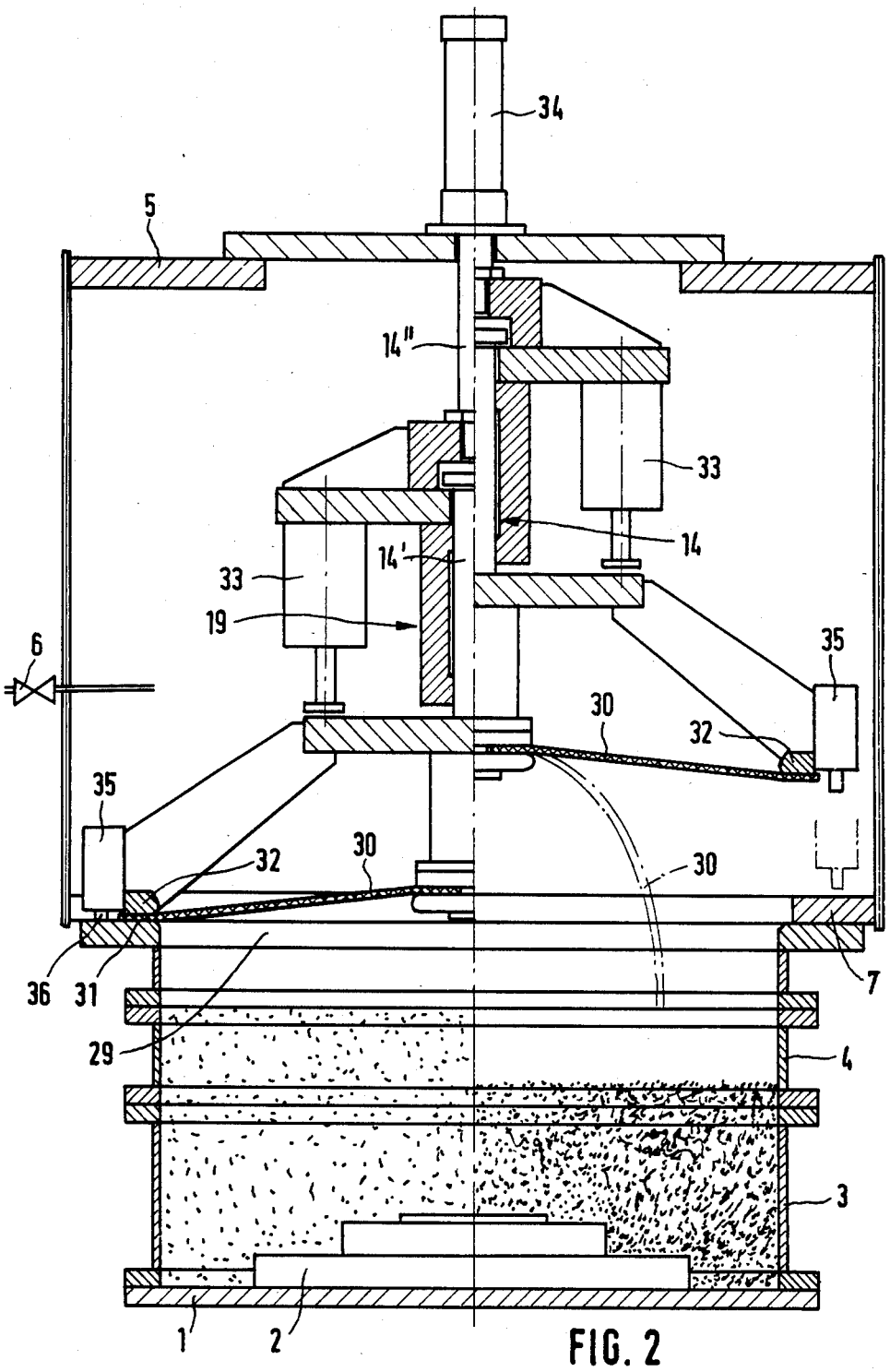

As shown in FIG. 2, the floor or lower wall 7 of the pressure vessel 5 has an opening 29 that may match the inner form of the filling frame (so that it will then be rectangular) or it may be round and as large as possible. The opening 29 is covered by a flexible valve diaphragm 30, fixed in place at its middle on the lower part 14' of the guide rod 14, that in the present case is bipartite. In the closed position, the valve diaphragm 30 is generally level and has its edge 31 forced gas-tightly against the floor 7 of the pressure vessel 5 around the opening by a loading frame or ring 32 that is fixed on the lower part 14' of the guide rod 14 and may be shifted axially therewith, the axial stroke being limited by shock absorbing cylinders 33, which are fixed to the top part 14" of the guide rod 14. Furthermore the guide rod has a clamping device 19 similar to the arrangement of FIG. 1. Lastly, the guide rod 14 has a drive 34 with the same function as the driving piston 15 as in FIG. 1. The loading ring or frame 32 has a plurality of energy storing springs 35 disposed there around it, with the energy storing springs 35 being tensioned on the ring 32 and forced against the valve diaphragm edge 31 supported on the floor 7. For this purpose, the springs each have a downwardly extending plunger acting on the spring placed so that the lower end of each such plunger rests on the floor 7 of the pressure vessel 5.

In the closed position shown in the left of FIG. 2, the part 14' of the guide rod 14 is in the lower position. At its edge 31, the valve diaphragm 30 is pressed by the ring 32 gas-tightly against the floor 7. The energy storing springs 35 are tensioned. The guide rod 14 is locked by the clamping device 19.

For initiating the opening motion, the first step is releasing the clamping device so that there is nothing holding back the springs 35 and the ring or frame 32 jumps suddenly upwards and the shock absorbing cylinders 33 are compressed. At the same time the complete guide rod 14 is lifted by the drive 34. By virtue of the effect of the gas under pressure acting on the valve diaphragm 30 its edge is pulled out of the gap between the floor 7 and the ring 32. It is then swept by the gas inwards and downwards into the position shown in the right of FIG. 2 so that the greater part of the opening cross section is cleared and uncovered. While this is going on, the foundry sand in the flask 3 and the filling frame 4 is compacted. As soon as the pressure has been completely equalized, the valve diaphragm is moved upwards again and because of its elasticity in the form of a restoring force it comes up against the ring 32 (see the top position of the valve diaphragm in the right hand part of FIG. 2). After this the guide rod 14 together with the ring 32 is moved downwards until the plungers 36 of the springs 35 run against the floor 7 and are so tensioned. Lastly, the ring 32 clamps the edge 31 of the valve diaphragm 30 against the floor 7. The top part 14" of the guide rod is again lifted a little by the drive 34 so that the ring or frame 32 has the necessary play or clearance in relation to the shock absorbing cylinders 33.

We claim:

1. An apparatus for a compaction of foundry mold making material using gas under pressure, the apparatus comprising a pressure vessel for the gas and forming a gas inlet chamber, a mold flask, a filling frame, a pattern plate and a pattern thereon onto which said material is loosely heaped, said flask, said frame and said plate forming a mold chamber placed under said pressure vessel, a valve interposed between said pressure vessel and said mold chamber, said valve having a movable valve member adapted to open up the flow cross section of said valve predominantly under an effect of gas under pressure in said pressure vessel, means for guiding said valve member within said pressure vessel, said valve member being adapted to perform an opening motion which is at least mainly directed into said mold chamber, said guiding means includes a middle guide rod for guiding said valve member and moving the same out of the open position into the closed position, and wherein a clamping means is provided for fixing said rod in the closed position of the valve member.

2. The apparatus as claimed in claim 1, wherein said valve member includes a moving valve plate with perforations, a stationary plate with perforation placed thereover between the pressure vessel and the mold chamber for cooperation with said moving valve plate, the perforations in said moving and stationary plates being out of alignment with each other to form a gas-tight seal between the plates, means for locking said moving valve plate in a closed position, and means for unlocking said locking means so that said moving valve plate may be accelerated by said gas under pressure into said mold chamber.

3. The apparatus as claimed in claim 2, wherein said valve plate has a rectangular form matching a rectangular cross section of of said mold chamber.

4. The apparatus as claimed in claim 2, comprising a sealing layer on one of said plates and disposed around all perforations in such plate.

5. The apparatus as claimed in claim 1, further comprising a fluid cylinder actuator for acting on said guide rod and closing said valve, said actuator being separable from said guide rod after the fixing of the guide rod by the clamping means at least at a start of an opening motion of said valve.

6. The apparatus as claimed in claim 2, wherein said perforations are slots.

7. An apparatus for a compaction of foundry mold making material using gas under pressure, comprising a pressure vessel for the gas and forming a gas inlet chamber, a mold flask, a filling frame, a pattern plate and a pattern thereon onto which said material is loosely heaped, said flask, said frame and said plate forming a mold chamber disposed under said pressure vessel, a valve interposed between said pressure vessel and said mold chamber, said valve having a movable valve member adapted to open up a flow cross section of said valve predominantly under an effect of gas under pressure in said pressure vessel, means for guiding said valve member within said pressure vessel, said valve member being adapted to perform an opening motion which is at least mainly directed into said mold chamber, means defining an opening forming a communication between said pressure vessel and said mold chamber, said movable valve member being formed as a thin valve diaphragm made of a flexible material adapted to cover an opening between the pressure vessel and the mold chamber, means for locking the thin valve diaphragm at an edge thereof in a closed position of said valve so that on release of said locking means said valve diaphragm may be forced downwards and towards a middle of the valve diaphragm into said mold chamber by an action of said gas under pressure.

8. The apparatus as claimed in claim 7, wherein said opening between said pressure vessel and said mold chamber corresponds to a cross sectional inner dimension of said mold chamber, the valve diaphragm is within the pressure vessel when the valve is in the closed position and has the edge thereof resting on said means for defining said opening.

9. The apparatus as claimed in claim 8, comprising a loading frame for maintaining said flexible fvalve diaphragm in the closed position of the valve, said loading frame acting downwardly on an outer edge of said valve diaphragm, and locking means cooperable with said loading frame.

10. The apparatus as claimed in claim 7, wherein said valve diaphragm is made of a material with elastic properties adapted to restore said valve diaphragm into a closed position.

11. The apparatus as claimed in claim 9, wherein said locking means cooperable with said loading frame comprises a two-part guide rod a lower part being adapted to be axially shifted to a limited degree in relation to a top part thereof, said loading frame being mounted for sliding motion on said lower part of said rod, energy storing spring means for acting on said loading frame, said spring means being supported adjacent said opening between said mold chamber and said vessel and being adapted to be tensioned when said valve is being closed, whereas, after release of said clamping means said loading frame is accelerated upwardly with said lower part of said rod by said spring means.

* * * * *